US006910311B2

(12) United States Patent
Lindberg et al.

(10) Patent No.: US 6,910,311 B2
(45) Date of Patent: Jun. 28, 2005

(54) MEMBERS WITH A THERMAL BREAK

(76) Inventors: Verne Leroy Lindberg, 10430 34th Dr. SE., Everett, WA (US) 98208; Michael Sparling, 2206 N. Spar La., Ellensberg, WA (US) 98926

( * ) Notice: Subject to any disclaimer, the term of this patent is extended or adjusted under 35 U.S.C. 154(b) by 0 days.

(21) Appl. No.: 10/165,093

(22) Filed: Jun. 6, 2002

(65) Prior Publication Data

US 2003/0226331 A1 Dec. 11, 2003

(51) Int. Cl.[7] ..... E04C 3/02

(52) U.S. Cl. ..... 52/731.9; 52/588.1; 52/717.01; 52/731.1; 52/731.7

(58) Field of Search ..... 52/731.1, 731.2, 52/731.8, 731.9, 733.2, 733.3, 737.1, 737.6, 739.1, 404.1, 717.02, 573.1

(56) References Cited

U.S. PATENT DOCUMENTS 3,332,197 A * 7/1967 Hinkle ..... 52/731.3
3,531,901 A * 10/1970 Will, Jr. et al.
5,313,762 A * 5/1994 Guillemet ..... 52/786.13
5,424,111 A * 6/1995 Farbstein ..... 428/137
5,485,709 A * 1/1996 Guillemet ..... 52/786.13
5,630,306 A * 5/1997 Wylie ..... 52/786.13
5,678,381 A * 10/1997 Denadel ..... 52/730.1
5,720,144 A * 2/1998 Knudson et al. ..... 52/731.9
5,768,849 A * 6/1998 Blazevic ..... 52/737.3
5,875,603 A * 3/1999 Rudd ..... 52/731.8
5,875,604 A * 3/1999 Rudd ..... 52/731.8
5,875,605 A * 3/1999 Rudd ..... 52/731.8
5,881,520 A * 3/1999 Blazevic ..... 52/281
5,881,529 A * 3/1999 Rudd ..... 52/737.3
5,921,054 A * 7/1999 Rudd ..... 52/731.8
6,055,788 A * 5/2000 Martin et al. ..... 52/731.6
6,134,859 A * 10/2000 Rudd ..... 52/737.3
6,161,361 A * 12/2000 Ehrenkrantz ..... 52/731.9
6,250,042 B1 * 6/2001 Rudd ..... 52/731.8
6,381,916 B1 * 5/2002 Maisch et al. ..... 52/736
6,397,550 B1 * 6/2002 Walker et al. ..... 52/653.1
6,405,498 B1 * 6/2002 Riegelman ..... 52/204.595
6,412,248 B1 * 7/2002 Rudd ..... 52/731.8
6,421,979 B1 * 7/2002 Fischer et al. ..... 52/745.19
6,494,012 B2 * 12/2002 Seng ..... 52/731.5
6,516,584 B1 * 2/2003 Rudd ..... 52/731.8
2001/0032436 A1 * 10/2001 Riegelman ..... 52/786.13

* cited by examiner

*Primary Examiner*—Carl D. Friedman
*Assistant Examiner*—Yvonne M. Horton
(74) *Attorney, Agent, or Firm*—Mark Zovko

(57) ABSTRACT

Members formed from thermally conductive components which have a gap therebetween. The gap is bridged and the conductive components integrated into a composite member by a reinforced polymer. This provides a thermal break which inhibits the flow of heat between the conductive components of the member. This construction also blocks the transfer of sound and other vibrations between the conductive components of the member. The construction also mitigates the formation of condensation on an artifact fixed to one of the components.

21 Claims, 8 Drawing Sheets

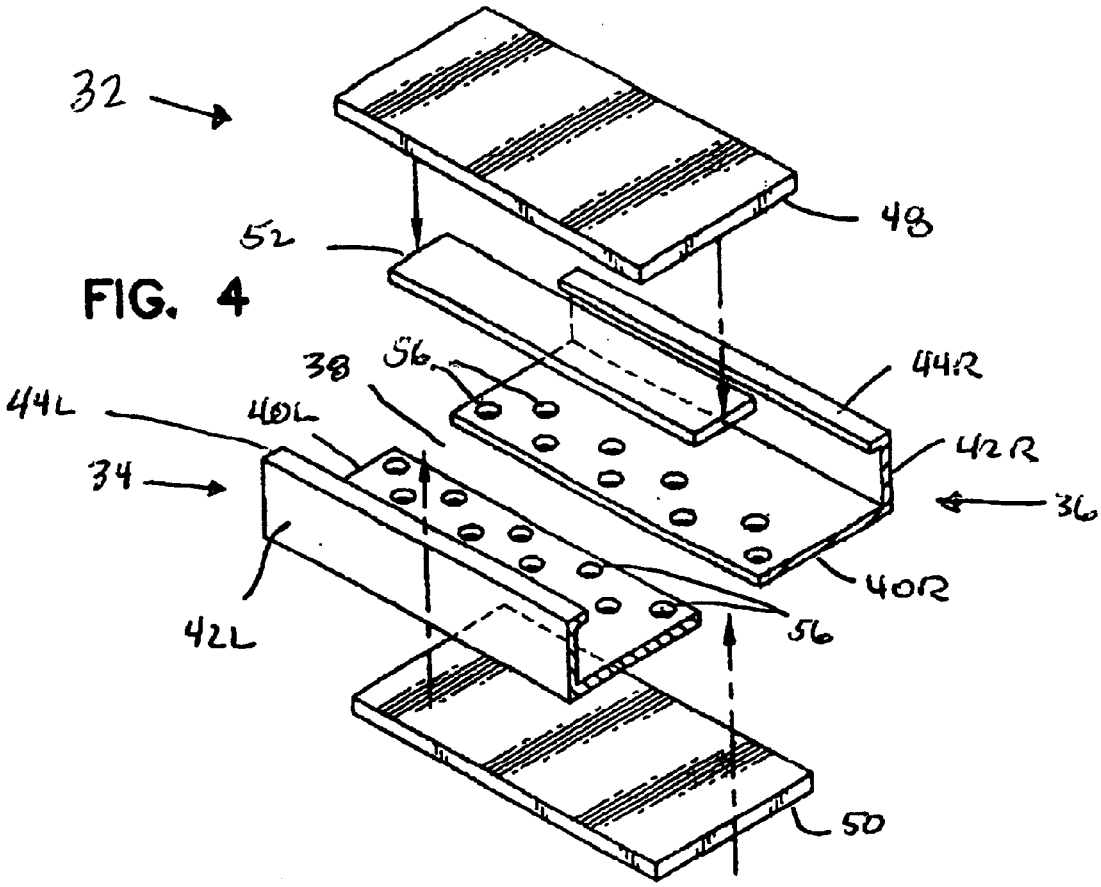
FIG. 4
FIG. 5
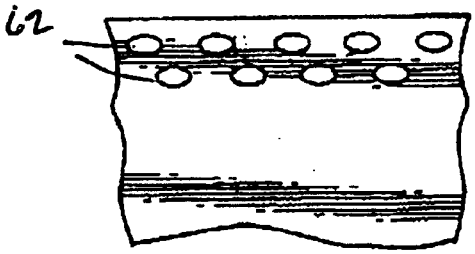
FIG. 6
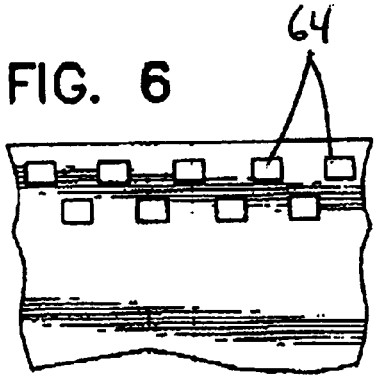
FIG. 7
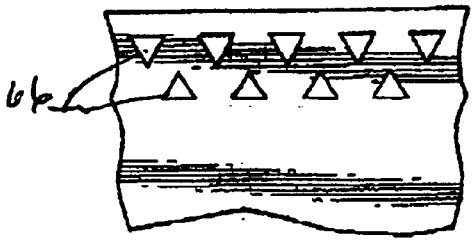
FIG. 8
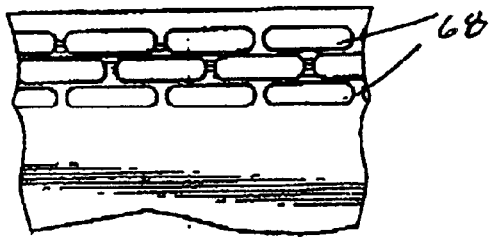

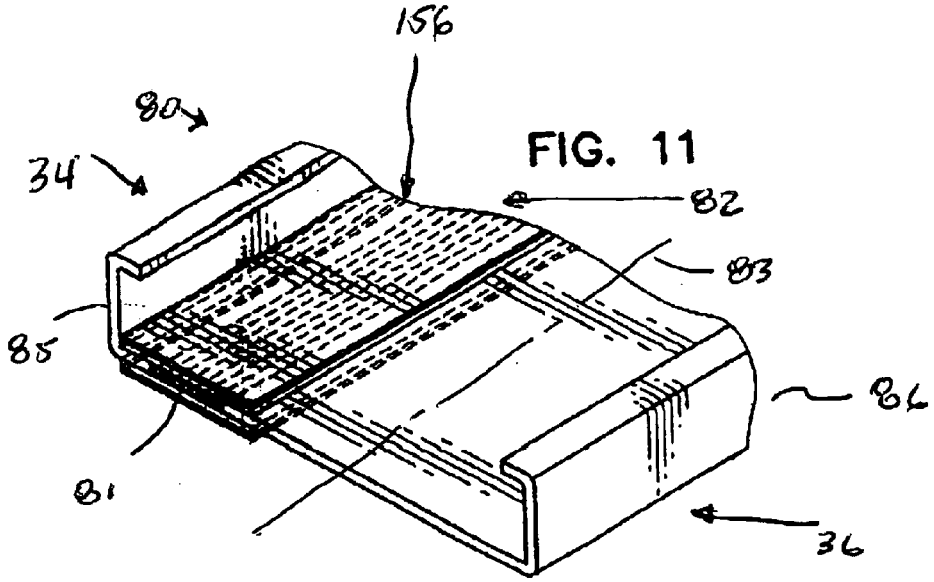
FIG. 11
FIG. 12
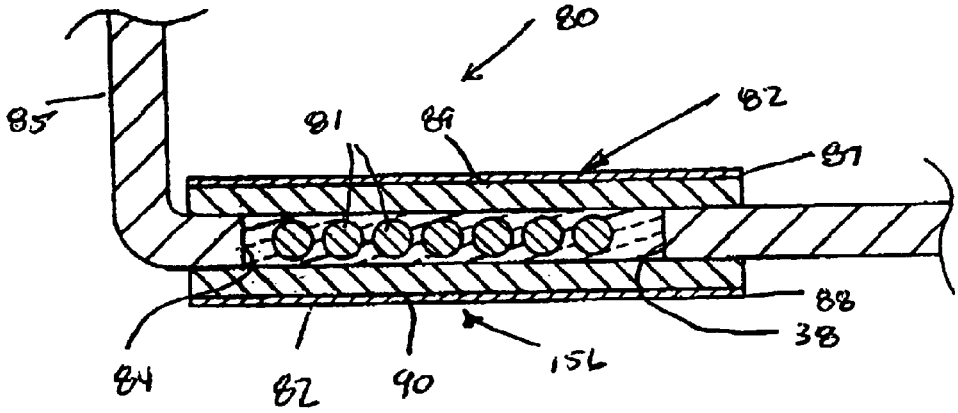
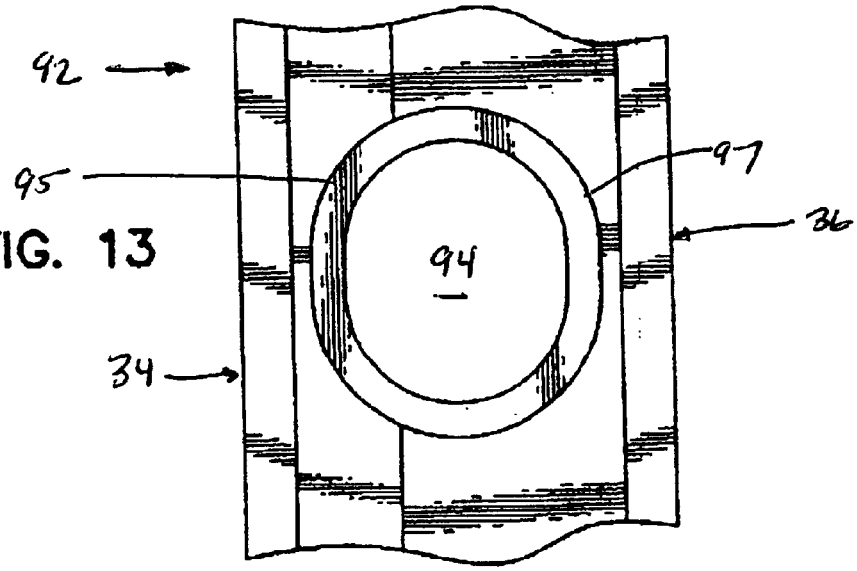
FIG. 13

123
141
121
151
151
151

MEMBERS WITH A THERMAL BREAK

TECHNICAL FIELD OF THE INVENTION

The present invention relates to novel, improved members with features which inhibit the transfer of heat from one edge of the member to another. These features also inhibit the transmission of sound and other vibrations and mitigate the formation of condensate.

One important application of the principles of the present invention is found in the provision of heat and vibration transfer resistant structural members for steel framed buildings, and what follows will be devoted primarily to that application of the invention. It is to be understood that this is being done for the sake of clarity and convenience and is not intended to limit the scope of the appended claims.

BACKGROUND OF THE INVENTION

Buildings and other structures with exterior walls, ceilings, floors, and/or roofs framed from steel components are ubiquitous because of the superior physical properties of steel vis-a-vis wood, concrete, and other building materials and because steel components commonly prove more economical because less material is used. One particularly significant disadvantage of such structural members is that they transfer heat from the interior of the building in which they are found to its exterior and in the opposite direction. Sound and other vibrations are transferred with equal facility.

This minimally inhibited transfer of heat is deleterious because it can result in the spreading of fire. And, in less severe instances, the transfer of heat through the steel members can result in an expensive loss of heat from the building in which they are found and/or can increase air conditioning costs by allowing the transfer of heat from the ambient surroundings to the interior of a building.

Different approaches to the problems dealt with in the preceding paragraphs have been proposed if not actually used. One is to configure a building component, in this case a stud, such that stagnant air pockets are formed between the exterior/interior edges of the stud and inner/outer panels covering the pocket-defining surfaces of the component. The just-described solution to the thermal isolation problem is disclosed in U.S. Pat. No. 4,235,057 issued Nov. 25, 1980.

The Executive Summary of the 1999 North American Steel Framing Alliance Business Plan (page 4A) suggests, in the abstract, the use of "greater thicknesses of cavity/wall insulation and/or exterior rigid board insulation to provide a thermal break." On page 9A of the Executive Summary, the authors recognize that there is a need for improved thermal performance. This need persists to the present day.

SUMMARY OF THE PRESENT INVENTION

A novel, cost effective solution to the heat transfer problem has now been discovered and is disclosed herein. Specifically, members embodying the principles of the present invention are composed of two (or more) components with a gap tberebetween. This gap is spanned, and the components of the member joined into a heat transfer resistant composite, with a thermally insulating, high strength, reinforced polymer. This inhibits the transfer of heat (or sound or other vibrations) from one component of the member to another. The result is a structural member which is strong and cost effective and which satisfactorily inhibits the transfer of heat and audible (and other) vibrations.

The reinforced, polymeric material may be bonded to the metallic elements of the structural member in any desired manner. For example, there are a number of sheet type adhesives which can be used for that purpose.

Other advantages of a member embodying the principles of the present invention are:

The formation of condensate on artifacts attached to the members is inhibited.

The members can be spaced further apart in a wall, ceiling, roof, etc. than comparably employed members fabricated from a material such as wood (typically 24 ins. on center versus 16 ins. on center for wall studs, and 48 ins. versus 24 ins. on center for roof trusses);

Structural members as disclosed herein can be easily designed by conversion and extrapolation of the dimensions, shapes and other properties of structural members fabricated from materials such as wood;

In many instances involving roof trusses, the commonly employed plywood underlayment is not required;

The composite structural members are non-flammable when a fire retardant is employed, are in large part made of recyclable materials (such as steel), and do not give off toxic fumes when heated;

All radiuses are easily formed;

The herein disclosed members are lighter and stronger than many members of other materials and configurations; and they have superior resistance to seismic disturbances and to high winds, of which hurricanes are one example; Also, they are resistant to condensation.

Such members don't shrink, rot, warp, creep, split, bow, buckle, twist, or creak under load; and they are immune to attacks by ants and other insects and vermin.

Because of the just-described properties, buildings employing these structural members typically may not require servicing to correct structural defects, and the cost of insurance may be lower.

Members embodying the principles of the present invention have a high degree of integrity, and construction of structures such as buildings is facilitated by such members;

Yet another advantage of the present invention is that its principles may easily be employed in products other than building components—for example, in turbine engine inlet filters.

Another advantage of the present invention is that batts and other preformed units of insulation can be used instead of the ubiquitous foamed and blown insulation although a foam or blown insulation can be employed if one so desires.

The objects, features, and advantages of the present invention will be apparent to the reader from the foregoing and the appended claims and from the accompanying drawings taken in conjunction with the accompanying description.

BRIEF DESCRIPTION OF THE DRAWINGS

FIG. 4 is an exploded view of the FIGS. 2 and 3 structural member;

FIGS. 5–8 (and FIG. 4) illustrate different configurations of holes that may be provided in the member's components to reduce the weight of the member, to provide a way in which thermal insulation elements or opposite sides of the webs may be brought into contact to bond the two components together, to impede the transfer of heat and vibrations from one member component to another; and to impede the condensation of moisture;

FIG. 11 is a perspective view of yet another embodiment of the present invention; in this embodiment a fiber-reinforced thermal break with reinforcing strands oriented at right angles to the flow of thermal energy is employed to provide a thermal break between two elements of a structural member in accord with the principles of the present invention; this figure also shows an asymmetric, often preferred location of the thermal break between inner and outer edges of the member;

FIG. 12 is a section through the member of FIG. 11; this figure shows more clearly a preferred orientation of the reinforcing strands (or rovings) in a plug located in the gap between first and second components of the member;

FIG. 13 is a plan view of a structural member embodying the principles of the invention which is aperatured to accommodate pipes, electrical conduits, and the like;

DETAILED DESCRIPTION OF THE INVENTION

Figure 1:
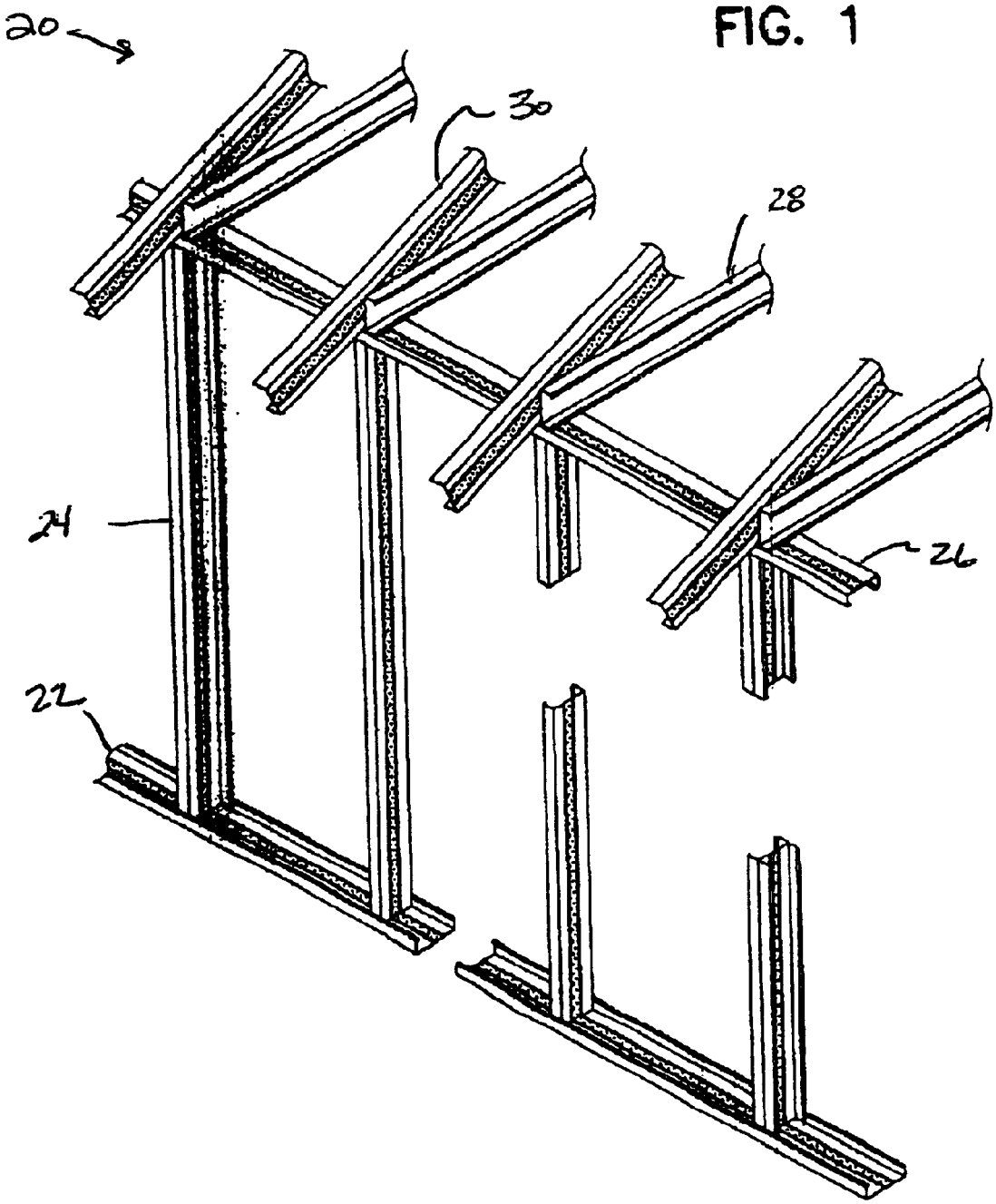
FIG. 1 is a partial perspective of a building framework; the framework has steel sills, studs, stud cap, ceiling joists, and rafters, all embodying the principles of the present invention.

The discussion which follows deals with multiple embodiments of the invention. To the extent that components of these embodiments are alike, they will be identified by the same reference characters.

Referring now to the drawings, FIG. 1 depicts a steel building framework 20. This framework is made up of a sill 22, vertical studs 24, and a top plate 26, or cap, supporting ceiling joists 28 and rafters 30. Framework components 22, 24, 26, and 30 embody, and are constructed in accord with, the principles of the present invention; and rafters 28 may be so constructed as to embody those principles.

Figure 2:
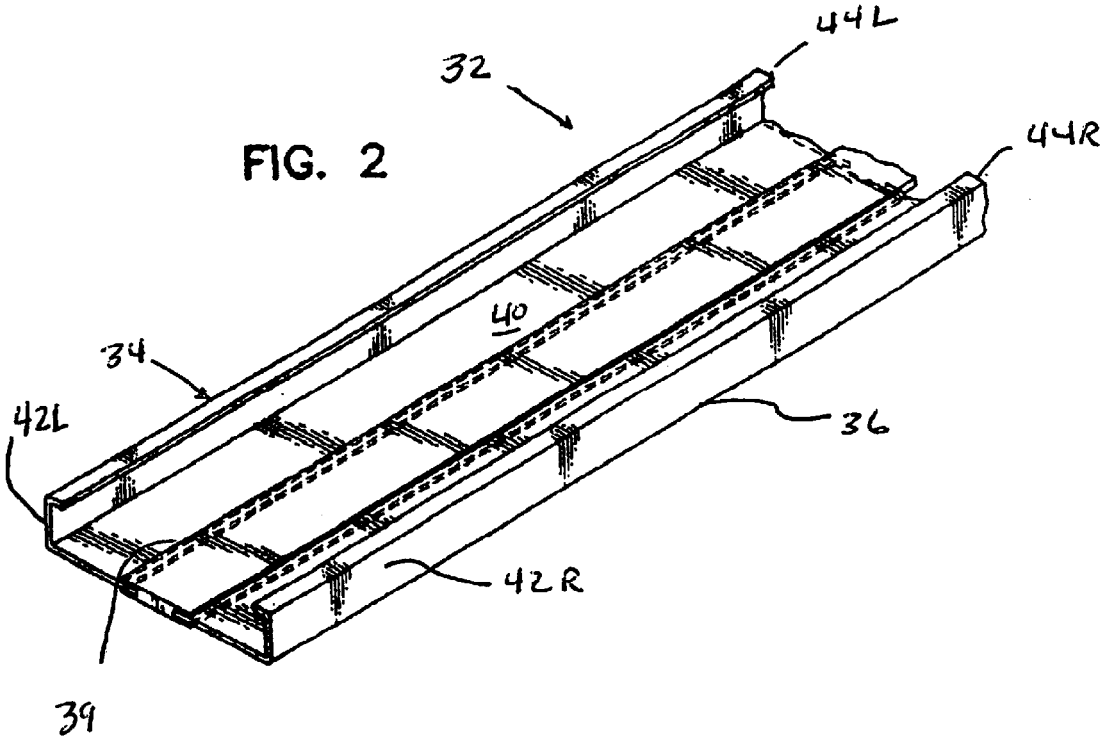
FIG. 2 is a perspective view of a structural member which embodies the principles of the present invention and which can be employed in the framework of FIG. 1.
Figure 3:
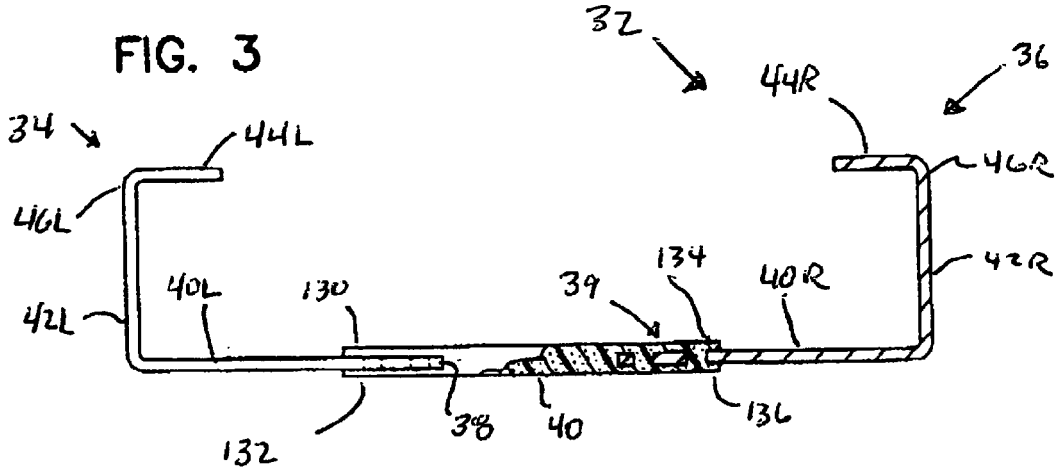
FIG. 3 is a cross sectional view of the structural member shown in FIG. 2.

A representative one of the structural components depicted in FIG. 1 is illustrated in FIGS. 2 and 3 and identified by reference character 32. Structural member 32 has two, substantially identical, mirror image-related, thermally conductive, vibration transmitting (typically steel) components 34 and 36 with a gap 38 therebetween. A third, insulating component 39 spans this gap, integrating the components 34 and 36 into an integral structure and providing a thermal break between components 34 and 36. This break minimizes the flow of heat between components 34 and 36. It also attenuates sound and other vibrations and makes panels or other artifacts attached to structural number 32 less susceptible to condensation.

As indicated above, the configuration and other characteristics of the two structural number components 34 and 36 are essentially identical. Therefore, in the ensuing description of those components, common features will be for the most part identified by the same reference characters with the suffixes L and capitol R being employed to identify the left-hand and right-hand components 34 and 36 of structural member 32 with that member oriented as shown in FIGS. 2 and 3.

As shown in FIGS. 2 and 3, each of the components 34 and 36 has a flat, web forming segment 40, an integral flange segment 42 oriented at right angles to element 40, and an also integral, inturned lip 44 extending at right angles from the exposed edge 46 of flange 42.

The insulating component 39 of structural member 32 is fabricated from two separate layers (or pads) 48 and 50 of an insulating material. In the manufacture of a representative structural member 32, these elements are fused together into a single entity (component 39) which is located in the gap 38 between the web-forming segments 40L and 40R of components 34 and 36 and laps onto the web-forming elements 40L and 40R of components 34 and 36.

At the present time, the preferred insulating material is TWINTEX, a material woven from multistrand rovings of a polypropylene and glass fibers. TWINTEX is available from Vetrotex America, Maumee, Ohio.

TWINTEX is an effective thermal insulator. It also has the advantage of being stronger than steel. Therefore, the strength of a structural member is not reduced by using that material to bridge the gap between adjacent components of that member. The TWINTEX material is 30 to 40 percent polypropylene and 70 to 60 percent fiberglass reinforcement.

The reinforcing glass fibers of the composite materials described above conduct heat to some extent. Consequently, it may be advantageous to fill the gap between the two components of a structural member as disclosed herein with a material which does not contain glass or other thermally conductive components. Urethane foams useful for this purpose are available from a variety of manufacturers. Such a strip is employed in structural member 32. This strip is shown in FIG. 4 and identified by reference character 52.

As shown in FIG. 4, holes (identified by reference character 56) maybe be punched or otherwise formed in the apposite segments 40L and 40R of the two components 34 and 36 of structural member 32. In the manufacture of the structural member, components 34 and 36 and the thermal insulation component 39 are heated to a temperature at which the polymeric constituent of the break-providing, thermal barrier material 39 flows in a manner akin to that of a high viscosity fluid into the aperture 56 along with the fibers embedded in that constituent of the insulating material. This creates multiple bonds between the two layers 48 and 50 of the fiber reinforced, thermoplastic material shown in FIG. 4, anchoring the two layers to each other and to the component segments 40L and 40R. These holes may be round (FIG. 4), elliptical (reference character 62 in FIG. 5) or, in many instances, may more effectively be of a polygonal configuration such as those square holes identified by reference character 64 in FIG. 6 and the triangular holes identified by reference 66 in FIG. 7. Another effective hole shape is the raceway configuration identified by reference character 68 in FIG. 8. Other configurations may of course be employed.

Figure 9:
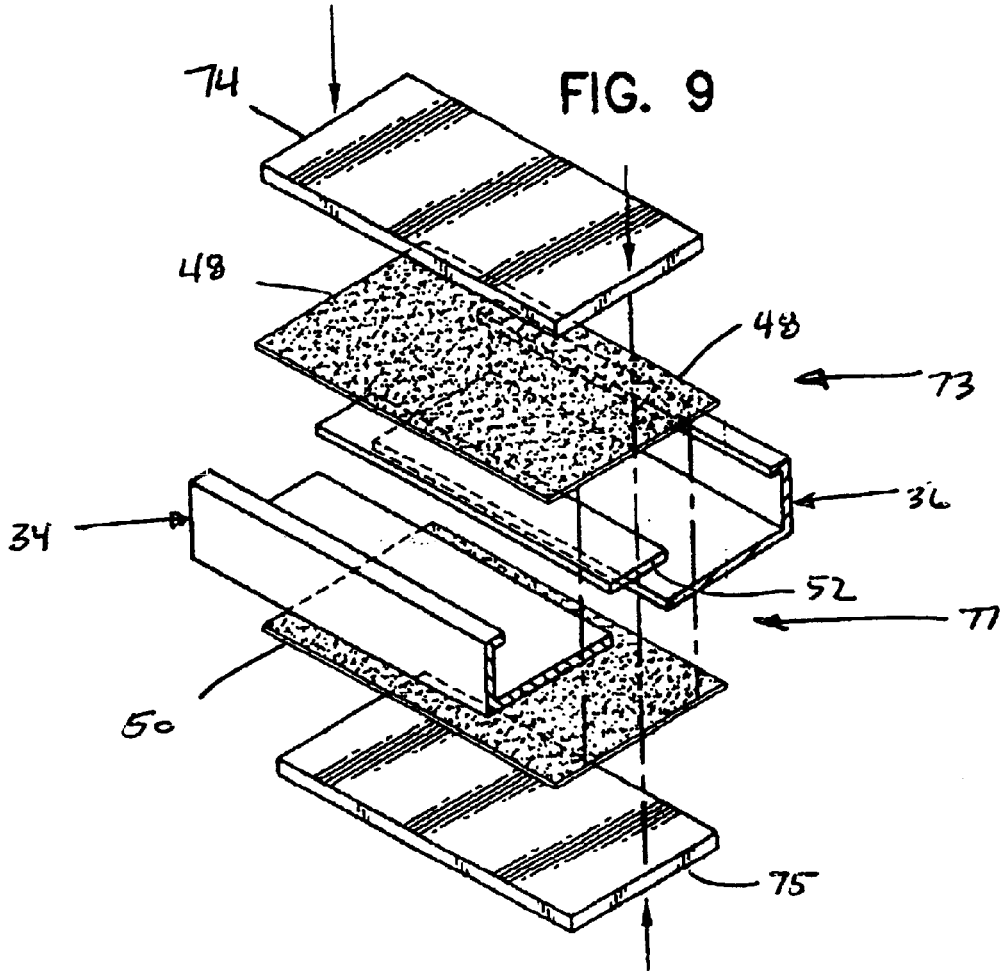
FIG. 9 is an exploded view of a second embodiment of the invention in which a thermal plug is employed to provide a thermal break between two components of a member.
Figure 10:
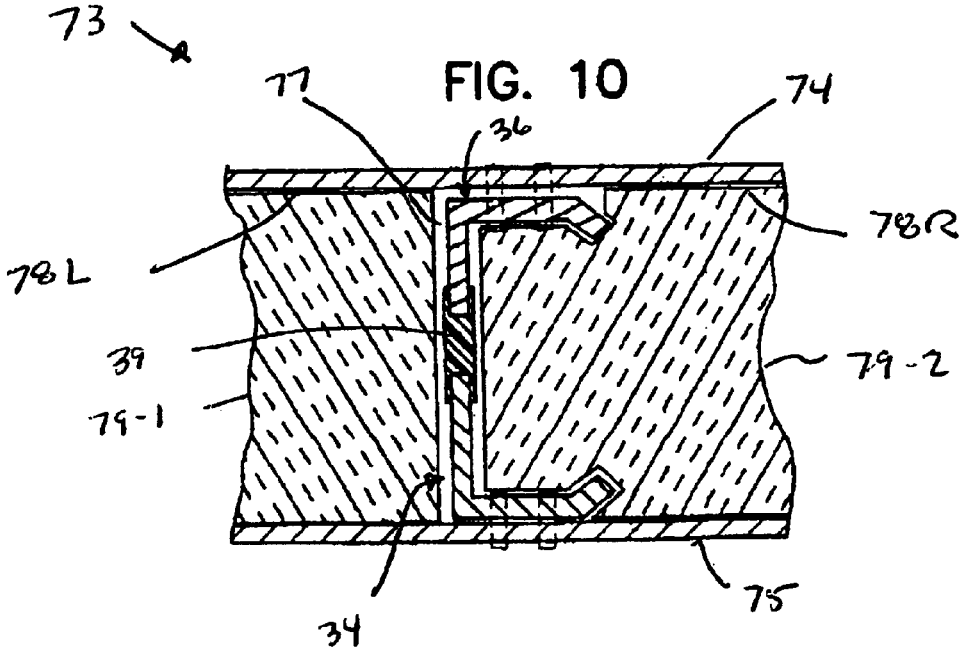
FIG. 10 is a section through the member depicted in FIG. 9.

Continuing with the drawings, FIGS. 9 and 10 depict, in fragmentary form, an installation 73 in which exterior and interior panels 74 and 75 are attached to opposite edges of a structural member 77 embodying the principles of the present invention. The arrangement shown in FIGS. 9 and 10 has the advantage that the spaces such as 78L and 78R between exterior and interior panels 74 and 75 can be filled with batts and other modules of insulation identified by reference characters 79-1 and 79-2 in FIG. 10. Of course, these spaces can instead be filled by blowing the insulation into spaces such as 78 and 79 or by foaming the insulation in those spaces, etc.

Referring still to FIG. 10, another advantage of the structural members disclosed herein is that, when temperatures fall, the transfer of heat from interior panel 74 to exterior panel 75 is significantly impeded. The result is that, under many, if not all conditions, the condensation of moisture (or sweating) on interior panel 74 is significantly reduced if not entirely eliminated.

Irrespective of the shape of the openings, they are preferably arranged in two staggered rows to reduce the transfer of thermal energy from one structural member component to another. This lengthens the paths along which thermal energy and vibrations are conducted, decreasing the ability of the structural member components in which the anchoring holes are formed to transfer thermal energy and vibrations.

FIGS. 11 and 12 depict a structural member 80 which embodies the principles of the present invention and in which the transfer of heat from one to the other of the two structural member components 34 and 36 is inhibited by orienting the parallel strands 81 of insulating material 82 in the gap 38 between the apposite edges 39L and 39R of structural component segments 40L and 40R at right angles to the longitudinal axis 83 of structural member 80. As discussed above, the transfer of thermal energy from one to the other of the structural member components 34 and 36 spanwise of the element 81 is significantly slower than the transfer of heat lengthwise of those elements. Therefore, the FIGS. 11 and 12 strand orientation is preferred for insulating materials which have only (or a considerable portion) parallel strands.

Structural member 80 also has layers (or on coatings) 87 and 88 of fire retardant on the exposed faces 89 and 90 of thermal barrier component 82. A fire retardant is used when the polymeric material of the insulation material is not flame proof.

As discussed above, superior performance can often be obtained by locating the thermal break-providing gap and insulation closer to an exterior wall end of the structural member than the inner wall. A structural member of the character just described is the structural member 80 illustrated in FIGS. 11 and 12. The thermal break gap 84 of structural member 80 is much nearer to the exterior wall supporting face 85 of structural member component 34 than it is to interior wall supporting face 86 of structural member 36.

Figure 14:
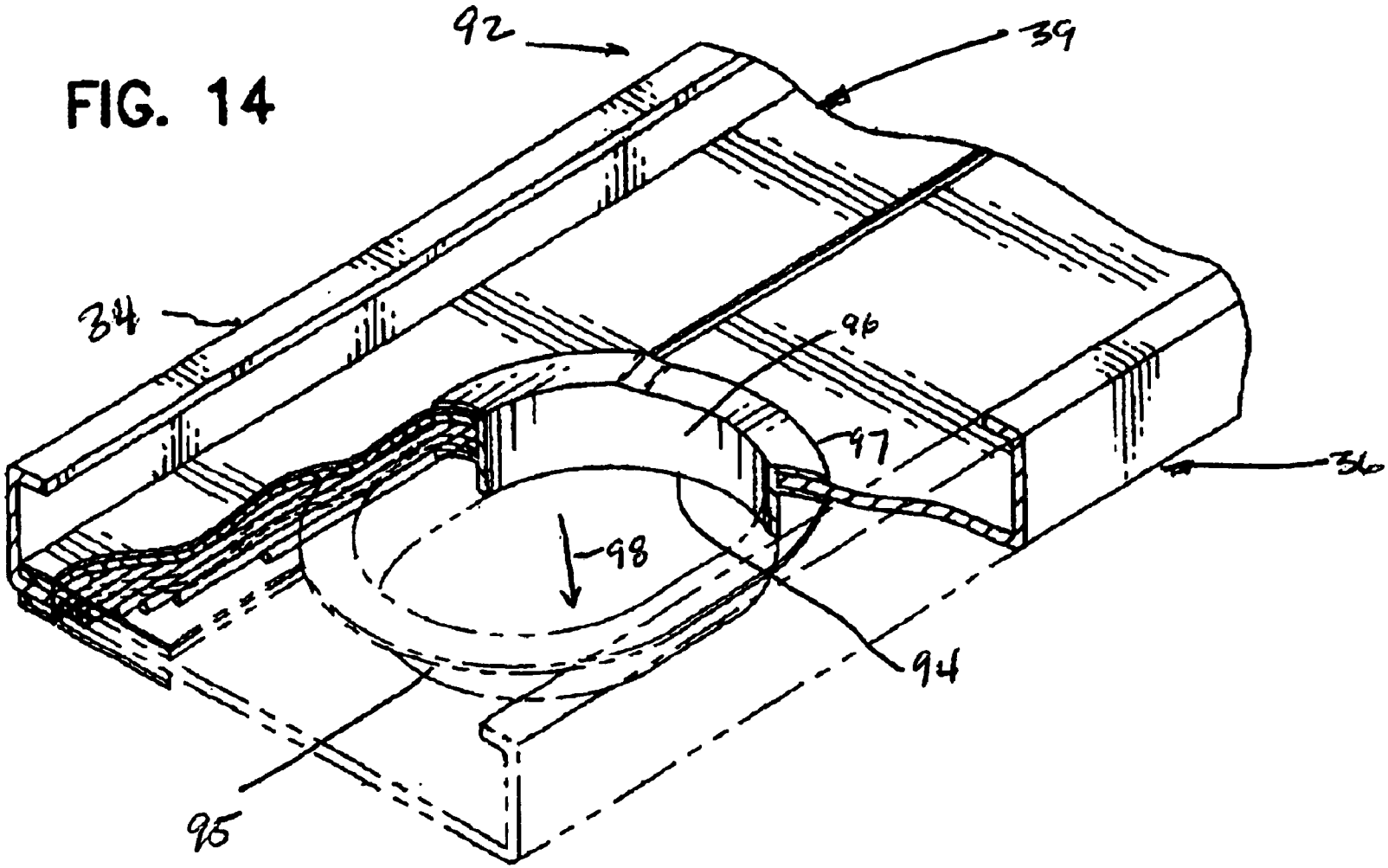
FIG. 14 is a perspective view of the FIG. 13 component.

As discussed above, it is conventional for pipes, electrical conduits, pipes, and the like to be routed through the structural members of a building's framework. A structural member with an opening provided for this purpose is depicted in FIGS. 13 and 14 and identified by reference character 92. As is best shown in FIG. 14, the hole 94 provided for the purposes just described is formed in any convenient fashion through the structural member components 34 and 36 and the third, thermal break-providing component 39 of structural member 32 of FIG. 10. As best shown in FIG. 14 a bushing 95 having a cylindrical barrel 96 and an integral, radially extending lip or flange 97 may optionally be installed in the opening 94 with the flange 97 of the bushing locating the bushing in the arrow 98 direction relative to the thermal break-providing component 39 of the structural member. This bushing adds to the structural member strength that may be lost by forming the necessarily fairly large hole in the structural member. Also, the insert isolates elements threaded through and in the hole from the usually rough edges of the hole, thereby protecting such elements from damage.

Figure 15:
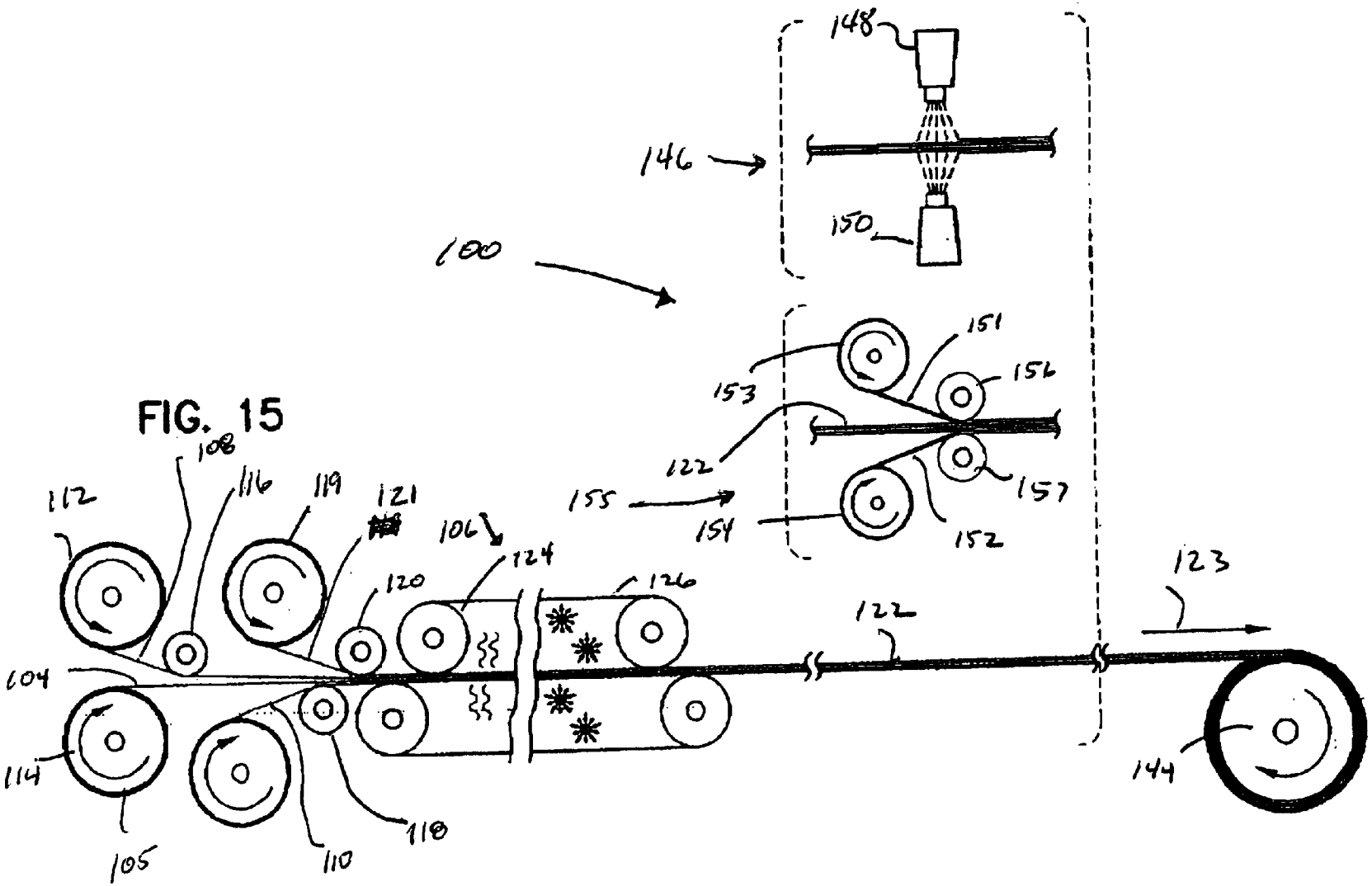
FIG. 15 is a schematic view of a line for manufacturing a preform of a structural member embodying the principles of the present invention.
Figure 16:
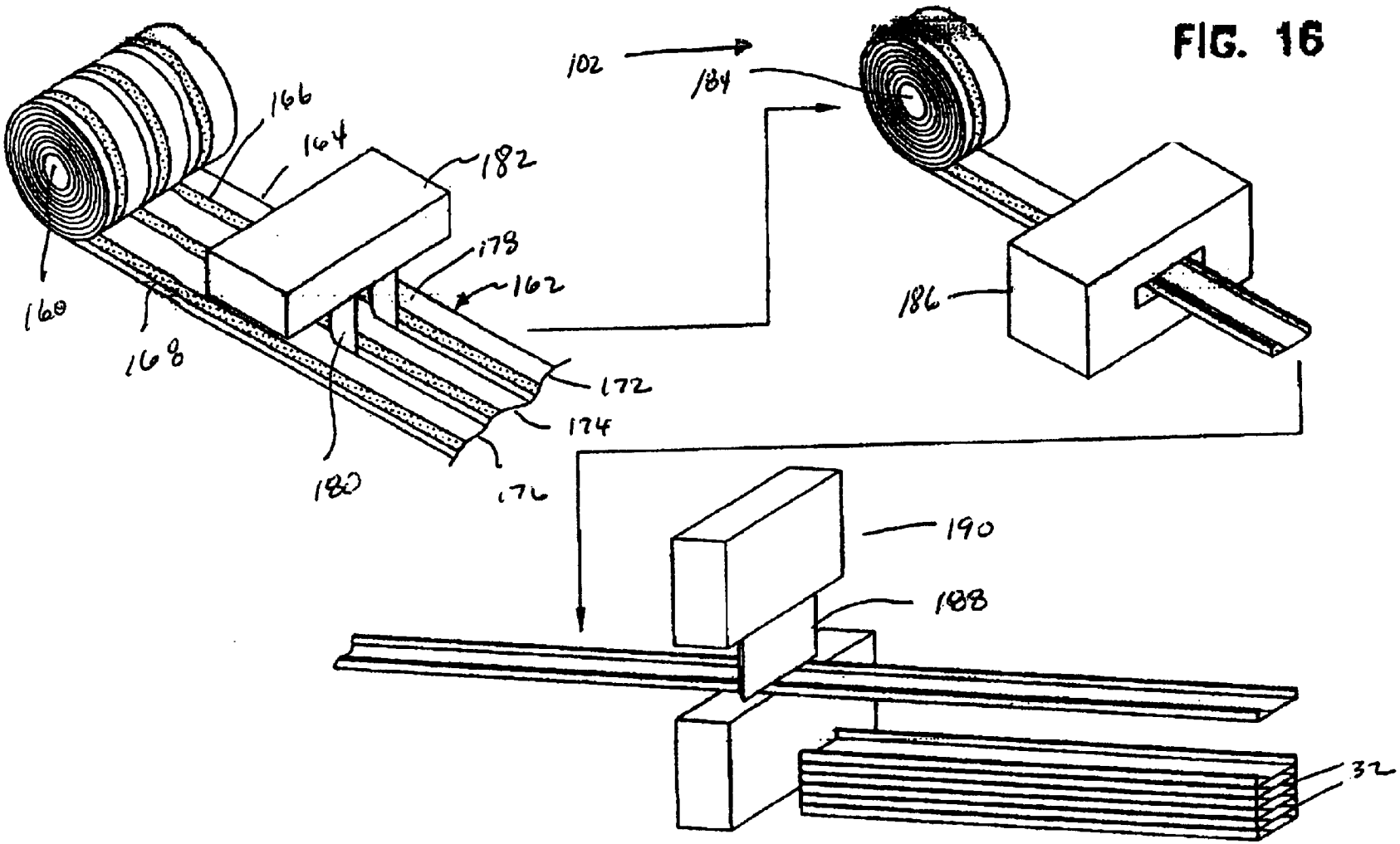
FIG. 16 is a schematic view of a line for converting a preform such as the one outputted by the FIG. 15 manufacturing line to a structural member of specific configuration, the structural members outputted from the FIG. 16 manufacturing line embody the principles of the present invention.

Referring still to the drawings, FIGS. 15 and 16 depict two manufacturing lines which may be employed in conjunction to fabricate structural members of the character described above. These manufacturing lines are respectively identified by reference character 100 (FIG. 15) and reference character 102 (FIG. 16)

In manufacturing line 100 a strip of metal 104 (steel in the above-discussed exemplary application of the invention) is fed from an unwind roll 105 to a work station identified generally by reference character 106. Strips 108 and 110 of TWINTEX or other selected insulating material are fed from unwind rolls 112 and 114 past idler rolls 116 and 118 to work station 106 on opposite sides of steel strip 104. At the same time, an adhesive film is fed through the work station 106 on both the top and bottom sides of strip 104 and between that strip and thermal insulation strip 108 and between steel strip 104 and thermal insulation strip 110.

For the sake of clarity, only one of the adhesive film supply arrangements is shown. This supply arrangement comprises unwind roll 119 and idle-roll 120; and the strip of adhesive is identified by reference character 121.

At the upstream end of work station 106, a sandwich 122 of two thermal insulation strips 108 and 110, two adhesive films, and steel strip 104 is created, This sandwich is fed in the arrow 123 direction first to a belt type heating unit 124 and then to a chilling unit 126 of similar construction. In heating unit 124, the adhesive films (only one of which is depicted) are heated to a temperature high enough for the adhesive to bond the strips of thermal insulation 108 and 110 to the opposite sides of steel strip 104.

At the same time, the polymeric matrix of the thermal insulation strips softens and is displaced along with its complement of reinforcing fibers into the gap between the two components 34 and 36 of the structural element 32 as shown in FIG. 3. The result is a H-section, thermal break-providing body of insulation. The edge segment of structural member element 40L is captured (or encapsulated) by two legs 130 and 132 of the insulating material. The other two legs 134 and 136 of the insulating material encapsulate complementary structural component element 40R, and the insulation material in the bar 134 of the H fills the gap 38 between the two structural component elements 40L and 40R (See FIG. 3).

The sandwich 122 of bonded together insulating and steel members 104, 108, and 110 (See FIG. 15) then passes to cooling unit 126. Here, the polymeric matrix of the fused together layers of steel and thermal insulating material is cooled to solidify and permanently bond the insulating layers to the metallic substrate. From the cooling unit the sandwich 122 of now bonded together layers is fed in the direction indicated by arrow 123 to a rewind roll 143 where the sandwich is wound on a mandrel 144.

Optionally as shown in FIG. 15, the sandwich 122 of fused together layers may be fed to a work station 146 before sandwich is wound on rewind roll 144. At station 146, nozzles 148 and 150 spray a fire retardant such as antimony trioxide on the two, exposed surfaces of the sandwich.

Alternatively, the fire retardant can be in strip form as indicated by reference character 151 and 152 in FIG. 15. Strips 151 and 152 are supplied from unwind rolls 153 and 154 in a work station 155. Press rolls 156 and 157 securely bond the fire retardant strips to sandwich 122.

An alternative to the above-discussed fire retardant coating is to employ an insulation tape or the like in which the fire retardant is incorporated in the insulating material. Indeed, there may be applications in which a combination of incorporated fire retardant and a fire retardant coating can be employed to advantage.

For some applications, the application of the thermal insulation to only one side of the structural member components may be sufficient. Preforms for such members can be manufactured on a line as illustrated in FIG. 15 with the bottom side thermal insulation unwind roll 114 and the companion adhesive unwind roll (not shown) inactivated or deleted.

As discussed above in conjunction with FIGS. 11 and 12, it is generally preferred that the thermal break between components making up a structural member embodying the principles of the present invention be nearer an exterior wall segment of the structural member than it is to the interior wall defining segment of the structural member. The FIG. 15 manufacturing line can be used where the thermal break gap (for example, gap 38 in FIG. 3) is symmetrically located with respect to the span of the structural component 32. However, if the gap 38 is asymmetrically located (FIGS 11 and 12) the location of the thermal insulation layers (reference character 156 in FIG. 13) will cause the sandwich of thermal insulation layers and steel substrate to run off of the mandrel of rewind roll 144 when the sandwich is rewound.

Next, sandwich 162 is split into structural member blanks or preforms 172, 174, and 176 by the knives 178 and 180 of work station 182. The preforms are each wound on a roll such as 184, unwound from that roll, formed to shape in work station 186 and cut to length by the knife 188 of work station 190.

In this circumstance, the manufacturing line 102 shown in FIG. 16 may advantageously be used to avoid the runoff problem. In this instance, an unwind roll 160 corresponding to the rewind roll 144 of manufacturing line 100 is employed. The thermal insulation/steel substrate sandwich 162 wound on roll 160 is fabricated in essentially the same manner as sandwich 122 (FIG. 15) except that the insulating material is so laid down as to span gaps (not shown) between substrate strips 164 and 166, substrate strips 166, and 168, and substrate strips 168 and 170, of the sandwich or perform 162. This balances the sandwich 162, keeping it from running off of unwind roll 160 as might happen in the case of a single, sandwich 122 with an asymmetrically located gap.

The reader will be aware that there are many applications in which the principles of the present may be employed to advantage in addition to those named above. For example, the material from which the structural member core is formed need not be steel, but may instead be brass, copper, or another alloy or metal or a non-metallic material, and the thermal barrier may be formed from a material other than the fiber reinforced polymeric material and polyurethane foam identified above. Therefore, the presented embodiments of the invention are to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A structural member having a web segment, the web segment comprising:

first and second components disposed in spaced apart relationship with a gap therebetween; and a third component which spans said gap and is bonded to said first and second components;

said first and second components each being fabricated of a thermally conductive material;

said third component comprising a rigid, high strength material which has low heat and vibration transmitting coefficients; and said material being of sufficient width to inhibit the flow of heat from one to the other of the first and second components, and wherein said third component has fire retardant applied thereto on at least one side.

2. A member as defined in claim 1 in which the third component comprises a reinforced polymer.

3. A member as defined in claim 2 in which the polymer is a polypropylene.

4. A member as defined in claim 3 wherein the polypropylene is one which will so change character upon being heated as to increase the thermal resistance offered by the third component.

5. A member as defined in claim 2 in which the reinforced polymer is adhesively bonded to the first and second components of the member.

6. A member as defined in claim 1 in which apertures are used in at least one of the first and second components to lighten the member and to further inhibit the transfer of heat and vibrations from one to the other of the structural member components.

7. A member as defined in claim 1 in which the reinforced polymer fills the gap between the first and second components of the structural member and overlies complementary first and second surfaces of those components.

8. A member as defined in claim 1 in which the assemblage of first and second components of the web segment and thermal insulation has an outer side wall and an inner side wall and in which the gap between the first and second components of the web segment is located closer to the outer side wall than it is to the inner side wall.

9. The combination of a member as defined in claim 1 and an artifact fixed to a side wall defined by one of the first and second components of the web segment.

10. A combination as defined in claim 9 in which the first and second components of the web segment define a second wall, wherein a second artifact is fixed to said second wall with a space between said artifacts, and wherein the space between the artifacts is filled with insulation.

11. A member as defined in claim 1 in which the gap between the first and second components of the web segment is filled with a fiber-reinforced, polymeric insulation.

12. A member as defined in claim 1 which has an aperture through at least one of the first and second web segment components and the third of the web segment components and wherein a rigid bushing is so installed in said aperture with a lip of the rigid bushing abutting a surface of the web segment component as to enhance the rigidity of the member and to avoid damage to artifacts passed through or in the aperture.

13. A member as defined in claim 1 in which the gap between the first and second components is filled with the material from which the third component is fabricated.

14. A member as defined in claim 1 in which the third component has an H-shaped spanwise configuration, an edge of one of the first and second components being encapsulated by first and second legs of the H, an opposite edge of the other of the first and second components being encapsulated by third and fourth legs of the H, and the gap between the first and second components being filled with the material in the cross bar of the H.

15. A structural member as defined in claim 14 in which openings are so provided in the first and second web segment components that they are filled with the material from which the third component is formed as to bond the first/second and third/fourth legs of the materials together and thereby securely anchor said legs together and to the first and second web segment components.

16. A structural member as defined in claim 1 in which the third component comprises: a polymeric foam filling the gap between the first and second web segment components and, on first and second, opposite sides of both the first and second web segment components, material comprised of a fiber reinforced polymer.

17. A structural member as defined in claim 1 having apertures in opposite marginal edges of the first and second components of the web segment to accommodate the flow of the third component material insulation material promoting a bond between layers of the material on opposite sides of the components, and anchoring the insulation material to the first and second components of the web segment.

18. A member as defined in claim 17 in which there are at least two rows of apertures in the marginal edge of at least one of the web segment components, the apertures in said rows being so staggered as to lengthen thermally conductive spanwise paths through each component in which the apertures are formed, thereby impeding the transfer of heat between inner and outer faces of the member.

19. A member as defined in claim 1 in which there is an insulation material in said gap that is different from the material of which said third component is fabricated.

20. A member as defined in claim 1 which has a plug of an insulating material in the gap between the first and second components of the member.

21. A structural member having a web segment, the web segment comprising:

first and second components disposed in spaced apart relationship with a gap therebetween; and a third component which spans said gap and is bonded to said first and second components;

said first and second components each being fabricated of a thermally conductive material;

said third component comprising a rigid, high strength material which has low heat and vibration transmitting coefficients; and said material being of sufficient width to inhibit the flow of heat from one to the other of the first and second components, wherein a fire retardant is incorporated into the material from which the third component of the web segment is formed.

* * * * *